US008146651B2

(12) United States Patent
Unger

(10) Patent No.: US 8,146,651 B2
(45) Date of Patent: Apr. 3, 2012

(54) HEAT EXCHANGER WITH RECESSED FINS

(75) Inventor: Michael Unger, North Lewisburg, OH (US)

(73) Assignee: Honda Motor Co., Ltd., Tokyo (JP)

( * ) Notice: Subject to any disclaimer, the term of this patent is extended or adjusted under 35 U.S.C. 154(b) by 792 days.

(21) Appl. No.: 12/244,952

(22) Filed: Oct. 3, 2008

(65) Prior Publication Data

US 2011/0168367 A1 Jul. 14, 2011

(51) Int. Cl.
*F28D 1/04* (2006.01)
*F01P 9/04* (2006.01)

(52) U.S. Cl. ..... 165/151; 123/41.57

(58) Field of Classification Search ..... 165/148, 165/150, 151, 152, 153, 172, 179, 181, 80.4; 123/41.56, 41.57
See application file for complete search history.

(56) References Cited

U.S. PATENT DOCUMENTS

| | | | | |
|---|---|---|---|---|
| 2,063,757 | A | 12/1936 | Saunders | |
| 2,072,975 | A | 3/1937 | Winsborough et al. | |
| 2,792,201 | A * | 5/1957 | Whistler, Jr. | 165/149 |
| 3,521,707 | A * | 7/1970 | Brown | 165/152 |
| 4,615,383 | A * | 10/1986 | Hisao | 165/150 |
| 4,966,230 | A * | 10/1990 | Hughes et al. | 165/150 |
| 5,490,559 | A * | 2/1996 | Dinulescu | 165/148 |
| 5,800,673 | A | 9/1998 | Okuda et al. | |
| 5,899,287 | A | 5/1999 | Kadlubski | |
| 6,005,772 | A * | 12/1999 | Terao et al. | 361/699 |
| 6,032,728 | A | 3/2000 | Ross et al. | |
| 6,073,686 | A | 6/2000 | Park et al. | |
| 6,182,745 | B1 | 2/2001 | Potier | |
| 6,332,495 | B1 | 12/2001 | Jamison et al. | |
| 6,397,938 | B1 | 6/2002 | Nishishita | |
| 6,826,050 | B2 * | 11/2004 | Suzuki | 361/703 |
| 7,373,905 | B2 * | 5/2008 | Fuchs et al. | 123/55.2 |
| 2007/0062677 | A1 * | 3/2007 | Usui et al. | 165/150 |
| 2009/0173477 | A1 * | 7/2009 | Raver | 165/151 |

* cited by examiner

*Primary Examiner* — Tho V Duong
(74) *Attorney, Agent, or Firm* — Plumsea Law Group, LLC

(57) ABSTRACT

A horizontally mounted heat exchanger with recessed fins is disclosed. The recessed fin configuration helps prevent damage to the fins that may occur when objects such as tools or soda cans are placed on the top surface of the heat exchanger.

20 Claims, 7 Drawing Sheets

HEAT EXCHANGER WITH RECESSED FINS

BACKGROUND OF THE INVENTION

1. Field of the Invention

The present invention relates generally to heat exchangers and in particular to a heat exchanger with recessed fins.

2. Description of Related Art

Several designs for intercoolers with protective covers have been previously proposed. Because the fins of an intercooler may present a generally flat surface, it is tempting for a user to rest an object on the intercooler. For example, a mechanic may rest a wrench on the intercooler while working on the motor vehicle. This can cause damage to the intercooler fins, which are usually very thin and lightweight.

There is a need in the art for an intercooler with provisions that reduce the tendency of the intercooler fins to be damaged. In particular there is a need for an intercooler design that solves the problems addressed here, including an intercooler design that does not use an extra cover or an intercooler with sharp edges.

SUMMARY OF THE INVENTION

A horizontally mounted heat exchanger with recessed fins is disclosed. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUV's, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy, for example, some engines include regenerative braking systems where kinetic energy from a drive train is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides a horizontally mounted heat exchanger, comprising: a set of corrugated fin portions, each corrugated fin portion disposed between adjacent tubes comprising a transverse tubing; a first set of top ends of the transverse tubing that form a first upper surface of the heat exchanger; a second set of top ends of the corrugated fin portions; and wherein the second set of top ends of the corrugated fin portions are recessed below the first upper surface.

In another aspect, the invention provides a horizontally mounted heat exchanger, comprising: a set of corrugated fin portions, each corrugated fin portion disposed between adjacent tubes comprising a transverse tubing; wherein the corrugated fin portions have a first height and the transverse tubing has a second height; and wherein the first height is less than the second height.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE EXEMPLARY EMBODIMENTS

Figure 1:
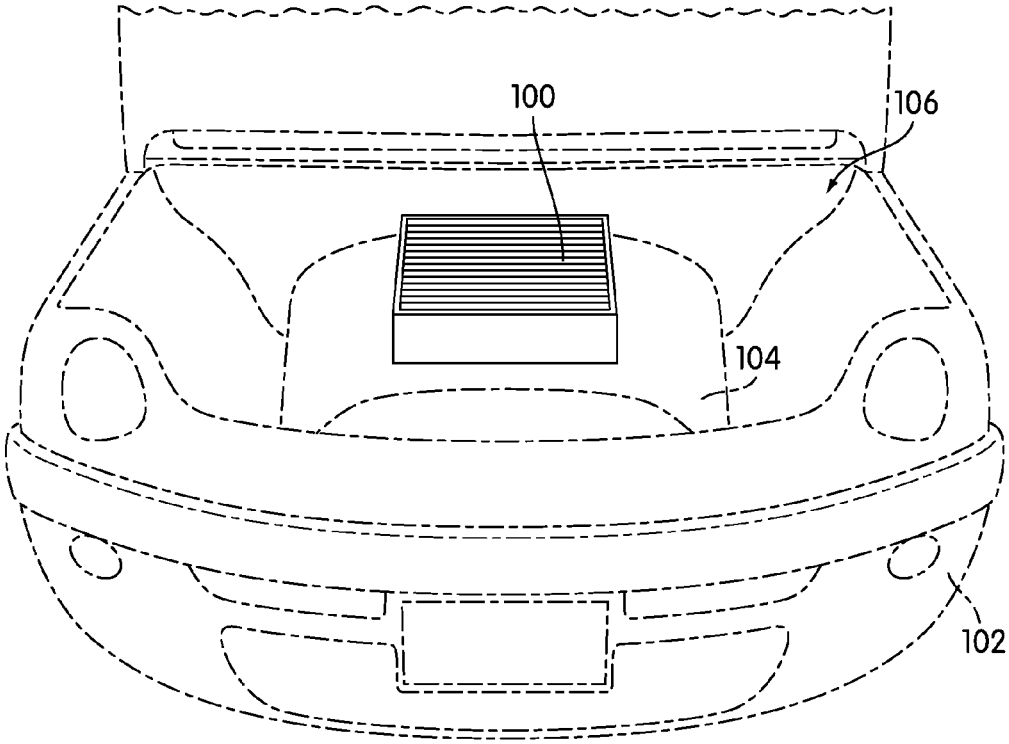
FIG. 1 is a front view of an exemplary embodiment of a motor vehicle with a top mounted intercooler.

FIG. 1 is an exemplary embodiment of intercooler 100. The term "intercooler", as used throughout this detailed description and in the claims refers to any type of charge air cooler. In particular, the term 'intercooler' refers to a charge air cooler or similar heat exchange device that is used in conjunction with a turbocharged or supercharged combustion engine. For purposes of clarity, the exemplary embodiment of intercooler 100 is shown here to be rectangular; however, in other embodiments, intercooler 100 could have another design and/or shape.

It should be understood that the principles discussed here for intercooler 100 may be applied to other types of heat exchangers. The term "heat exchanger" as used throughout this detailed description and in the claims refers to any device capable of efficient heat transfer between two mediums. In particular, an intercooler can be considered as an air to air or air to liquid type heat exchanger that can be used in motor vehicles with supercharged engines. However, the principles taught in this detailed description can also be applied to other types of horizontally mounted heat exchangers. For example, in one embodiment, these methods could be applied to a horizontally mounted oil cooler used in various types of generators.

Intercooler 100 is disposed within motor vehicle 102 (shown schematically in FIG. 1). In some embodiments, intercooler 100 may be associated with engine bay 106. Intercooler 100 may be further associated with engine 104. Intercooler 100 may be a top mounted intercooler. A top mounted intercooler is generally any intercooler mounted within the engine bay and disposed on top of the engine itself. A top mounted intercooler differs from a front mounted intercooler that is generally disposed in front of the engine bay and may decrease airflow to the radiator and/or oil cooler. In other embodiments, intercooler 100 could be a V-mounted intercooler. A V-mounted intercooler is any intercooler that is mounted in a horizontal position, but that is disposed in front of the engine, rather than on top of the engine. In other embodiments, intercooler 100 could be another type of horizontally mounted intercooler.

Figure 2:
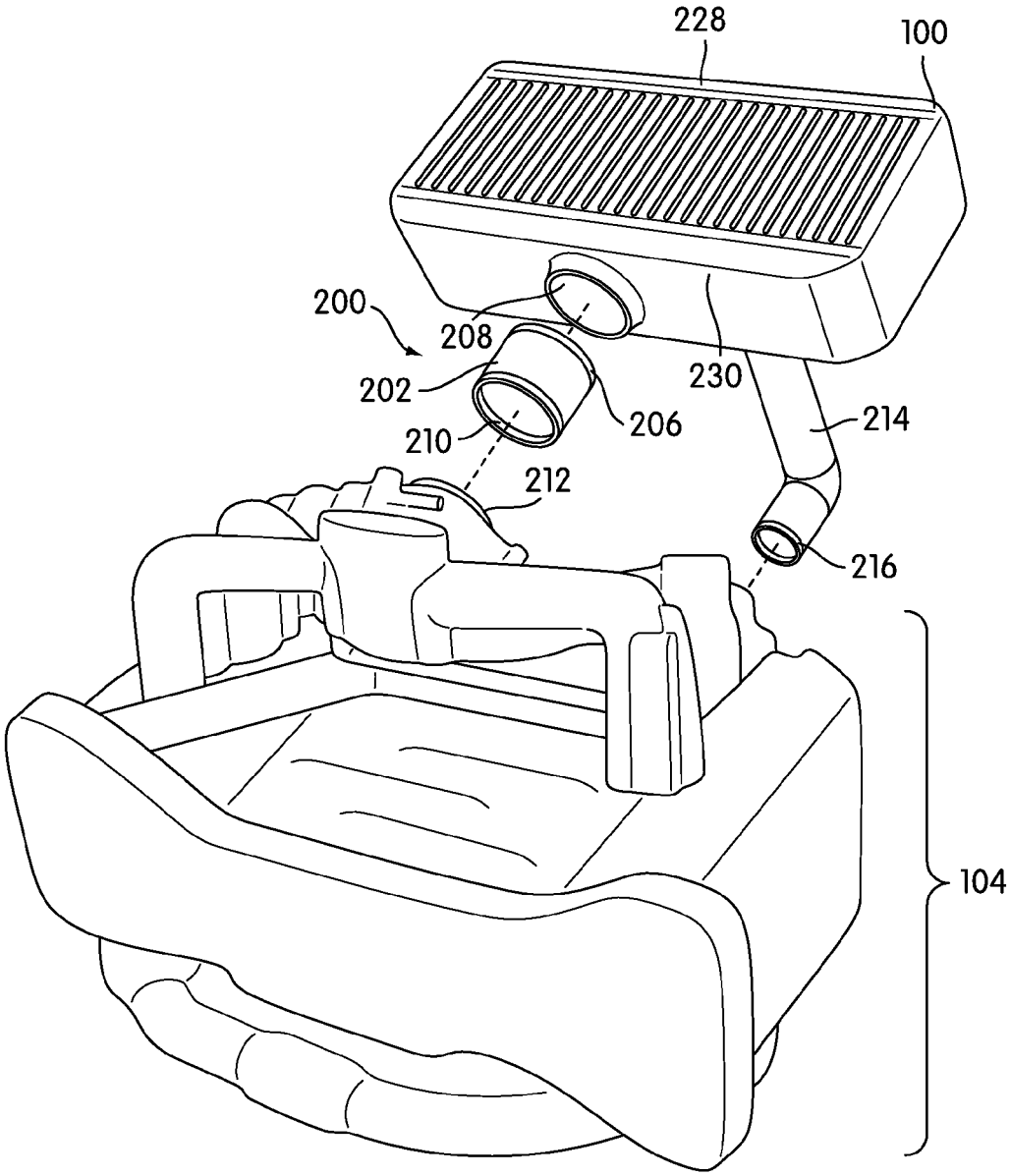
FIG. 2 is an exploded isometric view of an exemplary embodiment of an intercooler attached to a portion of an engine.

FIG. 2 is intended to illustrate the relation of the exemplary embodiment of intercooler 100 to engine 104. As previously discussed, intercooler 100 sits on top of engine 104. In an exemplary embodiment, intercooler 100 may be slightly tilted with respect to engine 104.

Intercooler 100 includes provisions for exchanging air with engine 104. Intercooler 100 may be associated with hosing system 200 configured to connect intercooler 100 with engine 104. Duct system 200 includes first major duct 202. In this embodiment, first end 206 of first major duct 202 is configured to connect to intercooler 100 at first port 208. Second end 210 of first major duct 202 is configured to connect to engine 104 at second port 212. Additionally, intercooler 100 includes second major duct 214, configured to attach to intercooler 100 at a first end and to engine 104 at a second end 216, in a manner similar to first major duct 202. With this arrangement, air from engine 104 may be circulated through intercooler 100 via first major duct 202 and second major duct 214. In particular, air from a compressor within the turbocharger may be cycled through intercooler 100 and returned to an intake manifold within engine 104 via major ducts 202 and 214.

Using a top mounted or horizontally mounted configuration for intercooler 100 allows intercooler 100 to be placed close to the turbocharger compressor. Also, intercooler 100 may be placed close to the manifold intake portion of the engine. By maintaining a closer proximity to the turbocharger of engine 104, a top mounted configuration for intercooler 100 decreases the length of intermediate duct that must be used to connect intercooler 100 with engine 104. This design helps eliminate lag from changes in pressure that may occur in front mounted intercooler systems that use longer hoses.

Intercooler 100 may be used with various other components that are often found in intercooler systems. In some embodiments, intercooler 100 could be used with a quick-spooling turbocharger or a ball-bearing turbocharger to further increase engine response. Also, to increase the flow of air to intercooler 100, a hood scoop or similar device may be used in some embodiments. Generally, intercooler 100 may be configured to include any other components that may be found in intercooler systems that do not interfere with the functions of the exemplary design that will be discussed throughout the rest of this detailed description.

Figure 3:
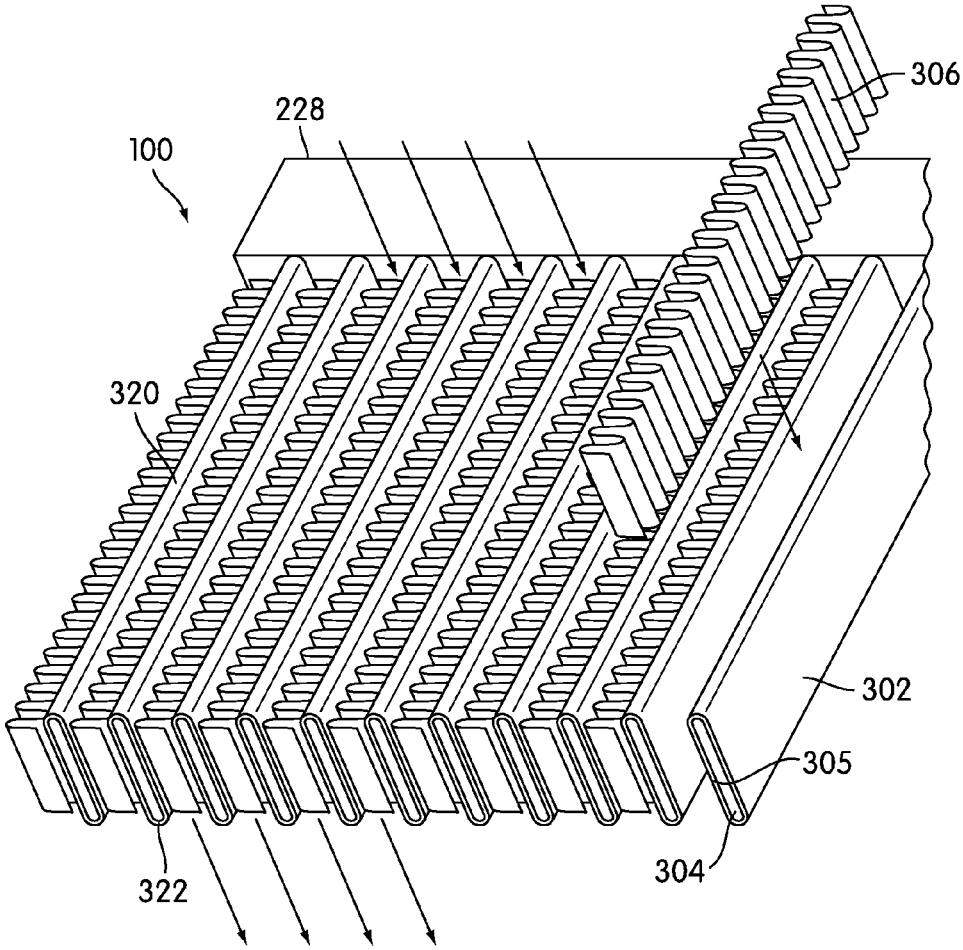
FIG. 3 is an isometric view of an exemplary embodiment of part of an intercooler.

FIG. 3 is an isometric view of an exemplary embodiment of a portion of intercooler 100. In the exemplary embodiment, intercooler 100 includes transverse tubing 302. Individual tubes comprising transverse tubing 302 run in parallel from a top edge portion 228 to bottom edge portion 230 (see FIG. 2) of intercooler 100. Each individual tube of transverse tubing 302 may include elongated cross section 304. This elongated cross sectional design allows for increased efficiency of intercooler 100 as more of the air traveling through transverse tubing 302 will contact inner walls 305 of transverse tubing 302. Transverse tubing 302 is also attached to top edge portion 228 and bottom edge portion 230 of intercooler 100. In some embodiments, top edge portion 228 or bottom edge portion 230 may include a hollow inner region configured to allow air exchange between various tubes comprising transverse tubing 302.

Furthermore, in the exemplary embodiment, corrugated fin portions 306 are disposed between each of the tubes comprising transverse tubing 302. In some embodiments, corrugated fin portions 306 are configured to have widths equal to the spacing between adjacent tubes. Corrugated fin portions 306 may be attached to adjacent tubes comprising transverse tubing 302 using any mechanical connection. In an exemplary embodiment, corrugated fin portions 306 may be welded or soldered to adjacent tubes comprising transverse tubing 302.

With this exemplary arrangement, air entering intercooler 100 may be cooled as it is distributed through transverse tubing 302 and exposed to ambient air streaming across and/or through intercooler 100. Furthermore, the corrugated fin design allows for an increased surface area for intercooler 100 as ambient air passes through intercooler 100 from top side 320 to bottom side 322. This increase in surface area increases the cooling efficiency of intercooler 100, as more heat can be transferred across this greater surface area.

In some cases, transverse tubing 302 and corrugated fin portions 306 are made of a material that has high heat conductivity. This configuration allows for maximum heat transfer between the internally circulated air within intercooler 100 and the streaming ambient air passing across and/or through intercooler 100. In some embodiments, transverse tubing 302 and corrugated fin portions 306 may be made of an aluminum alloy, such as commercially available brands, including "ALCAN" and "ALUMAX".

Because top mounted or horizontally mounted intercoolers may present a relatively flat surface in a crowded engine bay (see FIG. 1), a mechanic or motor vehicle owner may use the top of the intercooler as a workspace for placing tools, including wrenches and screwdrivers. In some cases, a mechanic or motor vehicle owner working under the hood of a motor vehicle may place other objects, including soda cans, for example, on top of the intercoolers generally flat surface. Generally, transverse tubing 302 may be thick enough to prevent any deformation due to the force applied by wrenches, screwdrivers or soda cans, for example. However, in order to achieve maximum airflow through intercooler 100, corrugated fin portions 306 may have a very narrow thickness, leading to potential deformation when similar forces are applied. In situations where corrugated fin portions 306 have been deformed, a decrease in the efficiency of intercooler 100 to cool air in an engine may occur. This decrease in the performance of the engine could lead to an overall decrease in power potentially provided by a turbocharged engine system, for example.

Intercooler 100 may include provisions that prevent corrugated fin portions 306 from being damaged when an object contacts intercooler 100 or is placed on top of intercooler 100. In an exemplary embodiment, corrugated fin portions 306 of intercooler 100 may be recessed to limit their contact with objects placed on top of intercooler 100.

Figure 4:
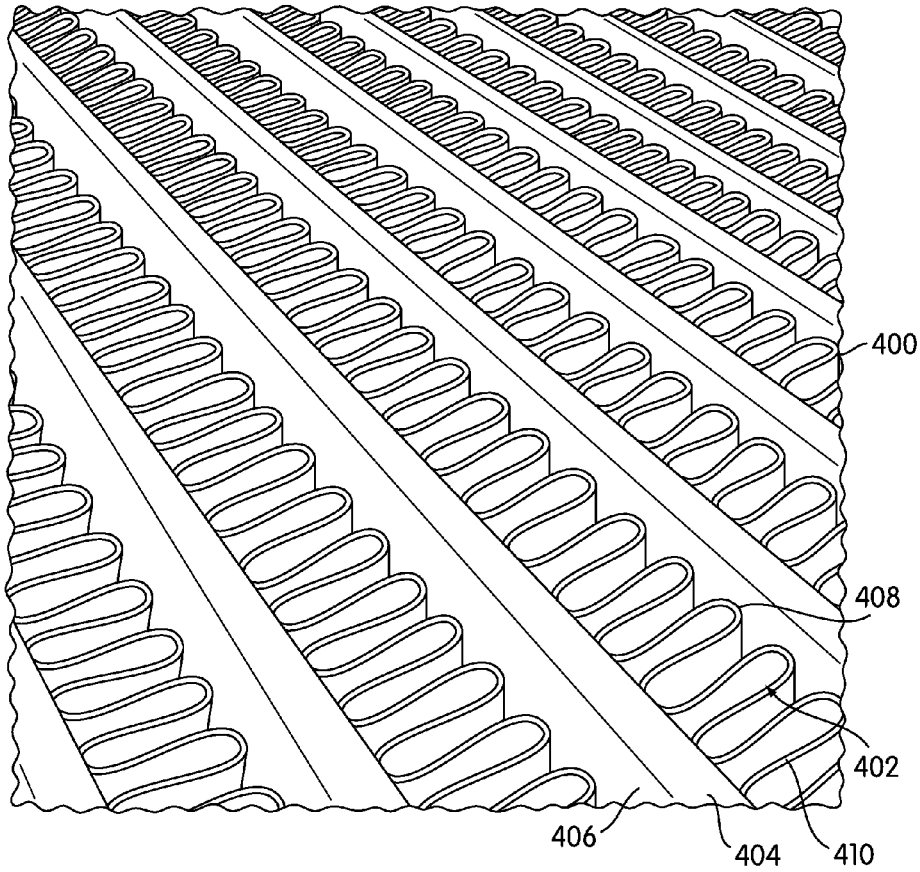
FIG. 4 is a close up view of an exemplary embodiment of the fins of an intercooler.

FIG. 4 is an isometric view of an exemplary embodiment of top surface 400 on intercooler 100. In the current embodiment, corrugated fin portions 402 may have a corrugation design that is S-shaped. In other words, fin tips 408 may be rounded. Also, fin sides 410 may be generally rounded, rather than straight. Although the exemplary embodiment includes corrugated fin portions with an S-shaped corrugated design, other embodiments may include other types of fin designs. In an alternative embodiment, shown in FIG. 5, corrugated fin portions 502 may have a corrugated design that is V-shaped. In other words, fin tips 508 may be pointed. In this alternative embodiment, fin sides 510 may be generally straight, rather than rounded.

Figure 5:
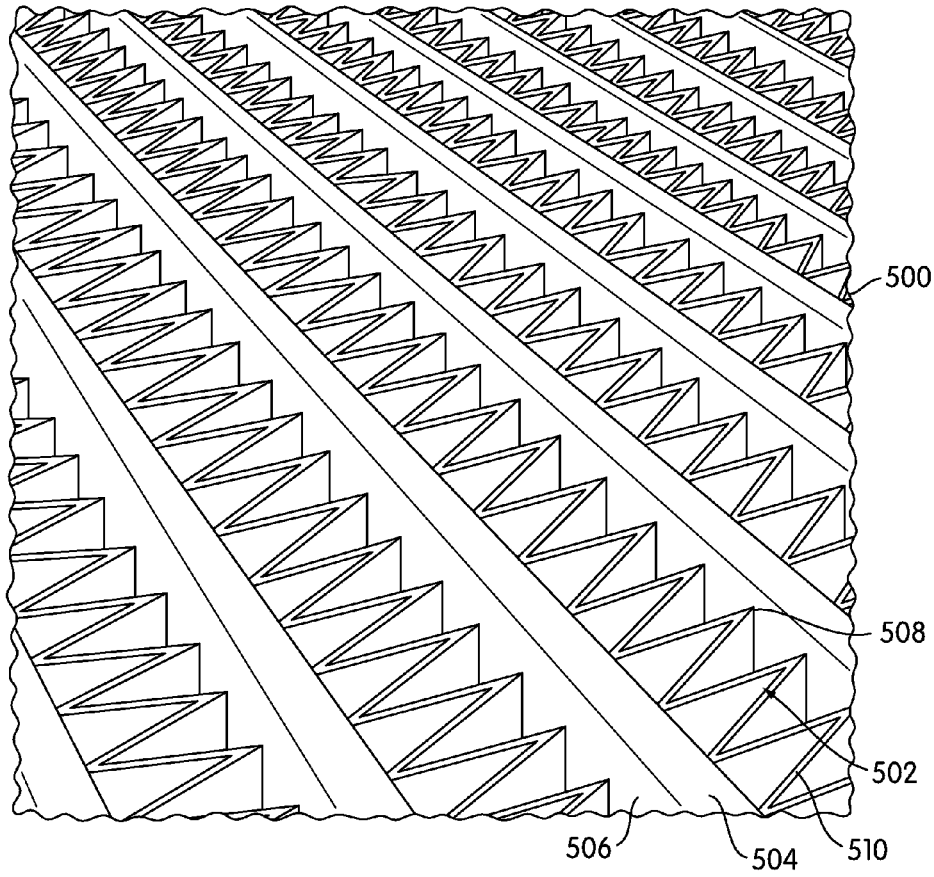
FIG. 5 is a close up view of an exemplary embodiment of the fins of an intercooler.

Referring to FIGS. 4 and 5, the exemplary embodiment of corrugated fin portions 402 and 502 may be recessed with respect to top sides 404 and 504 of transverse tubing 406 and 506, respectively.

Figure 6:
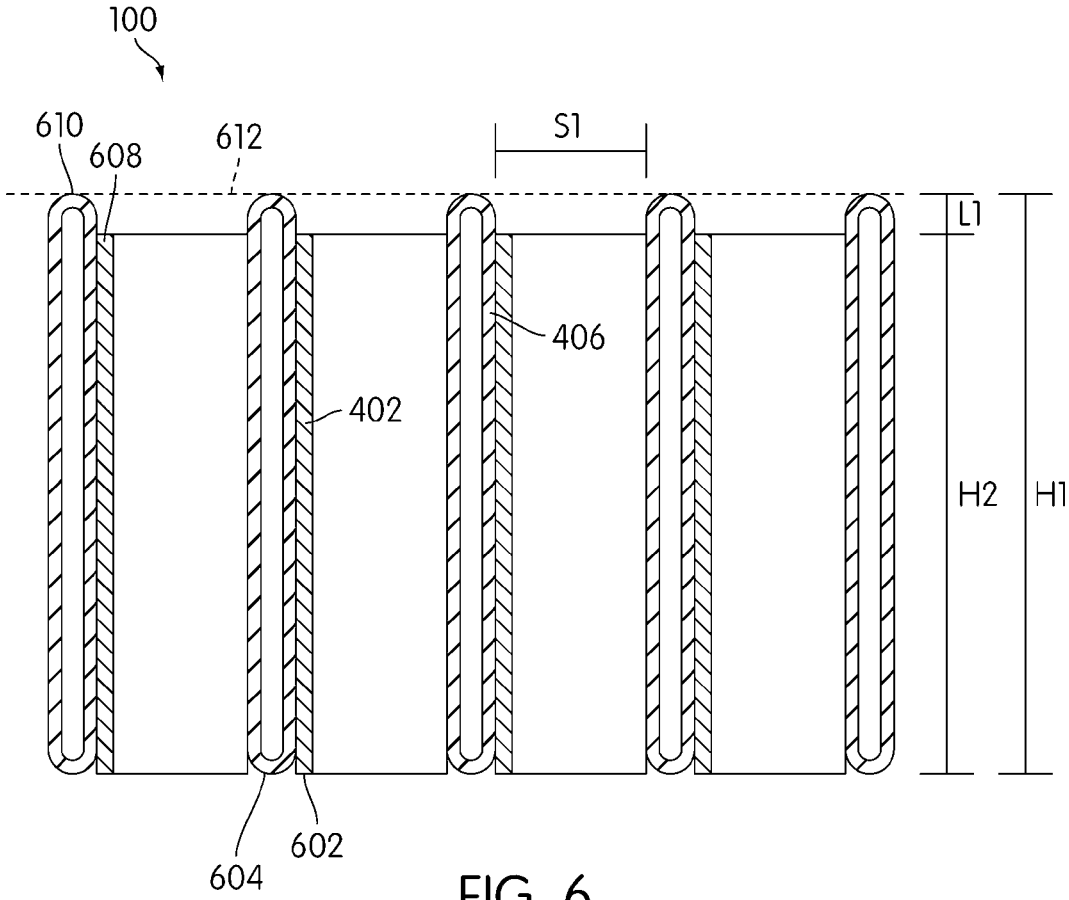
FIG. 6 is a side cross sectional view of an exemplary embodiment of an intercooler.

This recessed configuration can be clearly seen in FIG. 6, a side cross sectional view of an exemplary embodiment of a portion of intercooler 100. The embodiment shown in FIG. 6 is a cross sectional view of the S-shaped corrugated design of intercooler 100 seen in FIG. 4; however it should be understood that the same general principles apply to an intercooler with a V-shaped corrugated design as well. Generally, the following principles for recessing corrugated fin portions may be applied to any corrugated fin design used with intercoolers.

In this embodiment, transverse tubing 406 has a height H1 in the vertical direction. However, corrugated fin portions 402 extend only a height H2 in the vertical direction, where height H2 is less than height H1. In some embodiments, first bottom ends 602 of corrugated fin portions 402 are generally coincident with second bottom ends 604 of the tubes comprising transverse tubing 406.

First top ends 608 of corrugated fin portions 402 are recessed a length L1 below second top ends 610 of the tubes comprising transverse tubing 406. In some embodiments, length L1 may be between 1 and 10 millimeters. In other embodiments, length L1 may be between 1 and 5 millimeters. In an exemplary embodiment, length L1 may be between 2 and 3 millimeters.

In this exemplary embodiment, second top ends 610 of transverse tubing 406 may form a first upper surface 612 of intercooler 100. In this embodiment, second top ends 610 of transverse tubing 406 are separated by a spacing S1. First upper surface 612 of intercooler 100 approximates a flat surface. In particular, for objects with dimensions that are greater than spacing S1, first upper surface 612 will function as a flat surface. Generally, spacing S1 may differ from one embodiment of intercooler 100 to another. In some cases, the spacing S1 can be selected according to the output of intercooler 100. In other words, the spacing S1 can be selected to achieve a predetermined amount of cooling for a fluid in a supercharger or turbocharger. In some embodiments, spacing S1 may be between 1 cm and 25 cm. In other embodiments, spacing S1 may be between 1 cm and 15 cm. In an exemplary embodiment, spacing S1 may be between 1 cm and 5 cm.

Figure 7:
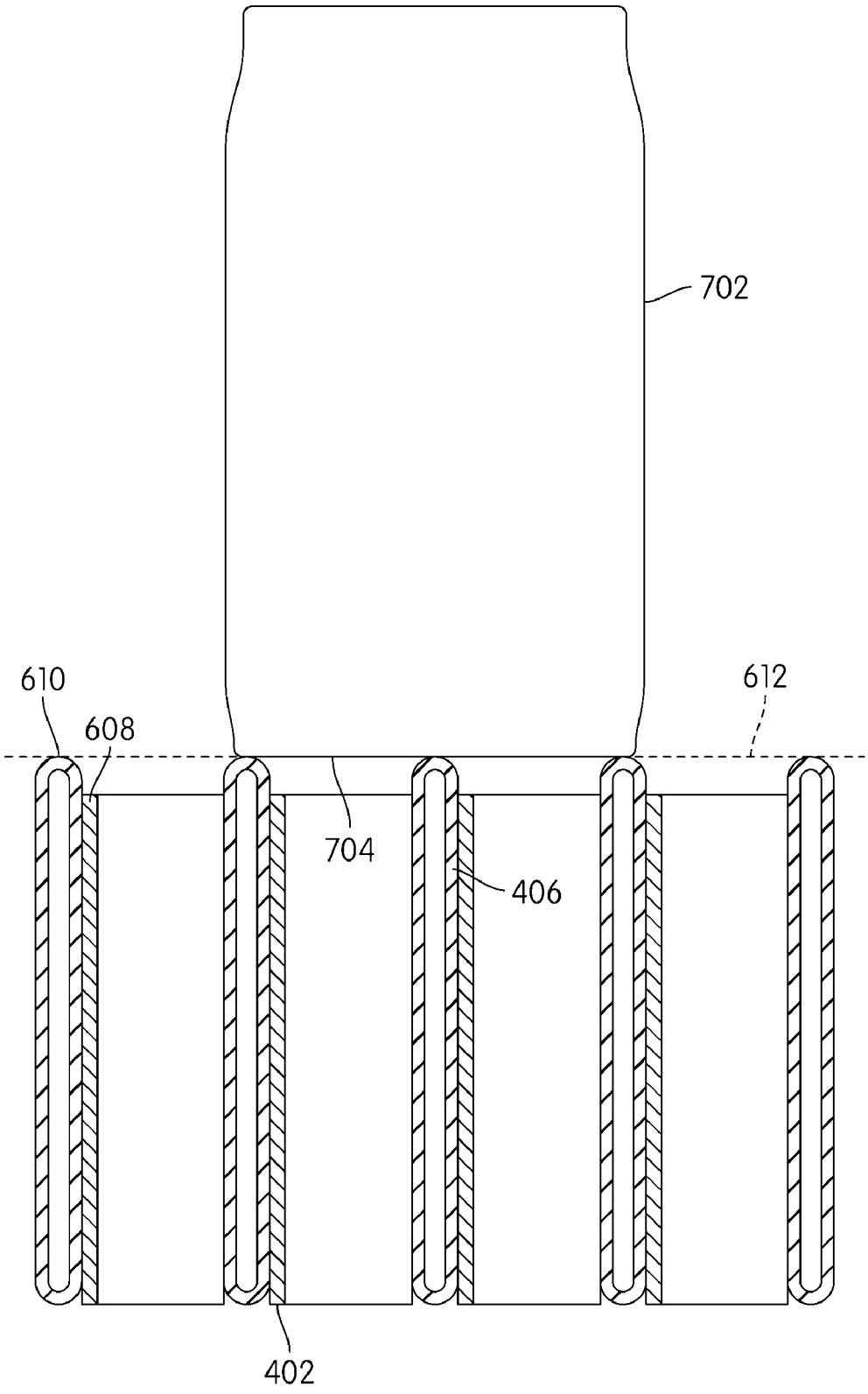
FIG. 7 is a side cross sectional view of an exemplary embodiment of an intercooler.

FIG. 7 is a side cross sectional view of an exemplary embodiment of a portion of intercooler 100 and soda can 702. In this exemplary embodiment, soda can 702 rests on first upper surface 612 formed by second top ends 610 of transverse tubing 406. In some cases, first top ends 608 of corrugated fin portions 402 are recessed far enough below first upper surface 612 that bottom side 704 of soda can 702 does not contact corrugated fin portions 402. With this configuration, corrugated fin portions 402 will not be damaged by typical objects that may be placed on top of intercooler 100, including wrenches, screwdrivers as well as other tools, so long as the dimensions of the object are generally larger than the spacing S1 between adjacent tubes comprising transverse tubing 406.

This configuration of intercooler 100 is distinct from previous designs that include transverse tubing and corrugated fins because previous designs generally include corrugated fin portions that are the same height as the transverse tubing. In particular, the tops of the corrugated fin portions in previous designs are generally coincident with the tops of the transverse tubing, leading to potential damage, as previously discussed.

In some embodiments, the reduction in the height of corrugated fin portions 402 in the current design may reduce the overall efficiency of intercooler 100 by a small amount, since the overall surface area of fin portions 402 has been reduced. However, this reduction in overall efficiency may be minimal, and in many cases results in a smaller reduction in efficiency than reductions due to other solutions previously proposed such as covering the top surface of the intercooler with a mesh webbing to prevent damage to corrugated fin portions.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A horizontally mounted heat exchanger disposed above an engine, the heat exchanger comprising:

a top side and a bottom side, wherein the bottom side is disposed closer to the engine than the top side;

a set of corrugated fin portions arranged to allow air to flow through the heat exchanger from the top side to the bottom side of the heat exchanger, each corrugated fin portion disposed between adjacent tubes comprising a transverse tubing;

a first set of top ends of the transverse tubing that form a first upper surface of the heat exchanger;

a second set of top ends of the corrugated fin portions; and wherein the second set of top ends of the corrugated fin portions are recessed below the first upper surface.

2. The horizontally mounted heat exchanger according to claim 1, wherein the horizontally mounted heat exchanger is an intercooler.

3. The horizontally mounted heat exchanger according to claim 1, wherein the corrugated fin portions are recessed below the first upper surface by a length between 1 and 10 mm.

4. The horizontally mounted heat exchanger according to claim 1, wherein the corrugated fin portions are recessed below the first upper surface by a length between 1 and 5 mm.

5. The horizontally mounted heat exchanger according to claim 1, wherein the corrugated fin portions are recessed below the first upper surface by a length between 2 and 5 mm.

6. The horizontally mounted heat exchanger according to claim 1, wherein the corrugated fin portions are recessed below the first upper surface by a length between 2 and 3 mm.

7. The horizontally mounted heat exchanger according to claim 1, wherein the corrugated fin portions have a first height.

8. The horizontally mounted heat exchanger according to claim 7, wherein the transverse tubing and the corrugated fin portions have coincident bottom portions.

9. The horizontally mounted heat exchanger according to claim 7, wherein the corrugated fin portions are V-shaped.

10. A horizontally mounted heat exchanger disposed above an engine, the heat exchanger comprising:

a top side and a bottom side, wherein the bottom side is disposed closer to the engine than the top side;

a set of corrugated fin portions arranged to allow air to flow through the heat exchanger from the top side to the bottom side of the heat exchanger, each corrugated fin portion disposed between adjacent tubes comprising a transverse tubing;

wherein the corrugated fin portions have a first height and the transverse tubing has a second height; and wherein the first height is less than the second height.

11. The horizontally mounted heat exchanger according to claim 10, wherein the heat exchanger is a top mounted intercooler.

12. The horizontally mounted heat exchanger according to claim 10, wherein the transverse tubing has an elongated cross section.

13. The horizontally mounted heat exchanger according to claim 10, wherein the tubes comprising transverse tubing include a set of first top ends, the set of first top ends collectively defining a first upper surface.

14. The horizontally mounted heat exchanger according to claim 13, wherein the corrugated fin portions include a set of second top ends, the set of second top ends collectively defining a second upper surface, wherein the second upper surface is disposed below the first upper surface.

15. The horizontally mounted heat exchanger according to claim 13, wherein the set of first top ends defining a first upper surface is configured to contact a foreign object before the set of corrugated fin portions.

16. The horizontally mounted heat exchanger according to claim 10, wherein the transverse tubing and the corrugated fin portions have coincident bottom portions.

17. The horizontally mounted heat exchanger according to claim 10, wherein the corrugated fin portions are attached to the tubes comprising the transverse tubing.

18. The horizontally mounted heat exchanger according to claim 17, wherein the corrugated fin portions are soldered to the transverse tubing.

19. The horizontally mounted heat exchanger according to claim 18, wherein the corrugated fin portions are S-shaped.

20. The horizontally mounted heat exchanger according to claim 19, wherein the corrugated fin portions are V-shaped.

* * * * *